US007866906B2

(12) United States Patent
Gueret

(10) Patent No.: US 7,866,906 B2
(45) Date of Patent: Jan. 11, 2011

(54) PACKAGING AND APPLICATOR DEVICE FOR APPLYING A COSMETIC OR ANOTHER CARE PRODUCT

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 12/656,144

(22) Filed: Jan. 19, 2010

(65) Prior Publication Data

US 2010/0129134 A1 May 27, 2010

Related U.S. Application Data

(63) Continuation of application No. 11/178,796, filed on Jul. 12, 2005, now Pat. No. 7,677,826.

(60) Provisional application No. 60/601,646, filed on Aug. 16, 2004.

(30) Foreign Application Priority Data

Jul. 13, 2004 (FR) ..... 04 51528

(51) Int. Cl.
*A45D 33/00* (2006.01)

(52) U.S. Cl. ..... 401/130; 401/126

(58) Field of Classification Search ..... 401/130, 401/126, 122, 270; 132/313, 317, 320; 15/207.2, 15/207

See application file for complete search history.

(56) References Cited

U.S. PATENT DOCUMENTS 2,168,179 A 8/1939 Tobey
3,692,417 A 9/1972 Aston
4,194,848 A 3/1980 Kingsford
4,411,282 A 10/1983 Wavering
4,437,477 A 3/1984 Gueret
4,974,980 A 12/1990 Gueret
5,542,439 A 8/1996 Gueret
5,761,760 A 6/1998 Dumler et al.
5,803,638 A 9/1998 Gueret (Continued)

FOREIGN PATENT DOCUMENTS

CN 1175189 A 3/1998

(Continued)

OTHER PUBLICATIONS

U.S. Appl. No. 11/439,183, filed May 24, 2006.

(Continued)

*Primary Examiner*—David J Walczak
(74) *Attorney, Agent, or Firm*—Oliff & Berridge, PLC

(57) ABSTRACT

A device may include an applicator including an applicator element that is at least partially elastically deformable and a receptacle configured to contain a substance to be applied and configured to house the applicator element when not in use. The receptacle may include an opening through which the applicator element passes while the applicator element is being removed from the receptacle. The applicator element may include at least one inner cavity that is defined, at least in part, between at least two branches that are at least partially flocked. An outside cross-section of the applicator element may be large enough for the applicator element to deform while passing through the opening of the receptacle, the deformation resulting in a shape of the cavity being modified.

20 Claims, 10 Drawing Sheets

U.S. PATENT DOCUMENTS

| | | | |
|---|---|---|---|
| 5,826,600 | A | 10/1998 | Rowe et al. |
| 5,888,005 | A | 3/1999 | Gueret |
| 5,913,318 | A | 6/1999 | Gueret |
| 6,033,143 | A | 3/2000 | Gueret |
| 6,067,997 | A | 5/2000 | Gueret |
| 6,120,202 | A | 9/2000 | Donsky |
| 6,220,254 | B1 | 4/2001 | Gueret |
| 6,305,861 | B1 | 10/2001 | Gueret |
| 2001/0033766 | A1 | 10/2001 | Gueret |
| 2002/0005209 | A1 | 1/2002 | Gueret |
| 2003/0235454 | A1 | 12/2003 | Gueret |
| 2004/0018037 | A1 | 1/2004 | Gueret |

FOREIGN PATENT DOCUMENTS

| | | | |
|---|---|---|---|
| CN | 1238931 | A | 12/1999 |
| CN | 2566685 | Y | 8/2003 |
| EP | 0 693 263 | A1 | 1/1996 |
| EP | 0 875 169 | A1 | 11/1998 |
| EP | 0 963 715 | B1 | 12/1999 |
| EP | 1 053 695 | B1 | 11/2000 |
| EP | 0 824 329 | B1 | 7/2002 |
| EP | 0 792 602 | B1 | 12/2002 |
| EP | 1 336 353 | A1 | 8/2003 |
| FR | 2412287 | | 7/1979 |
| FR | 2 771 077 | A1 | 5/1999 |

OTHER PUBLICATIONS

Office Action issued in U.S. Appl. No. 11/439,183 on Jan. 6, 2009.
Office Action issued in U.S. Appl. No. 11/439,183 on Dec. 15, 2009.
Translation of French Search Report issued in French Patent Application No. 0551353 on Feb. 14, 2006.
Office Action issued in Chinese Patent Application No. 200610080901.1 on Jun. 27, 2008 (with translation).
Office Action issued in Chinese Patent Application No. 200610080901.1 on Mar. 20, 2009 (with translation).
Office Action issued in U.S. Appl. No. 11/439,183 on May 7, 2010.

Fig.6
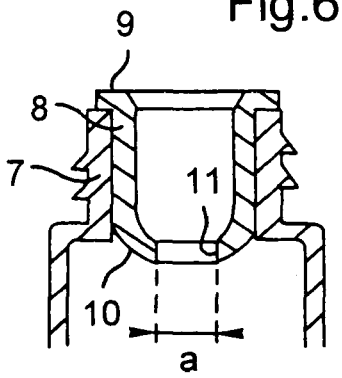
Fig.7
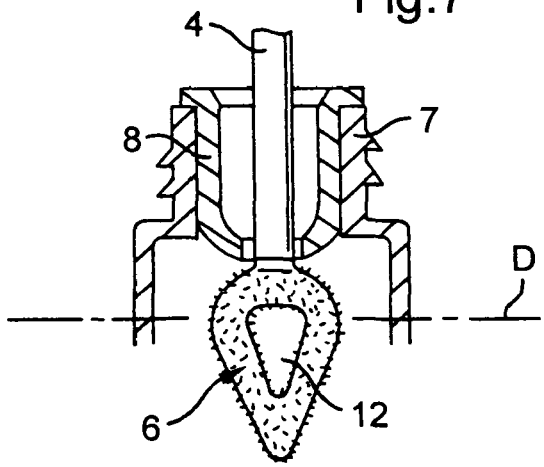
Fig.8
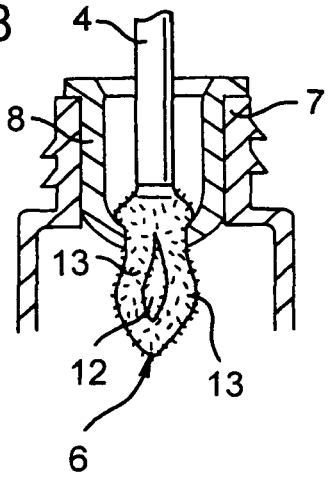
Fig.9
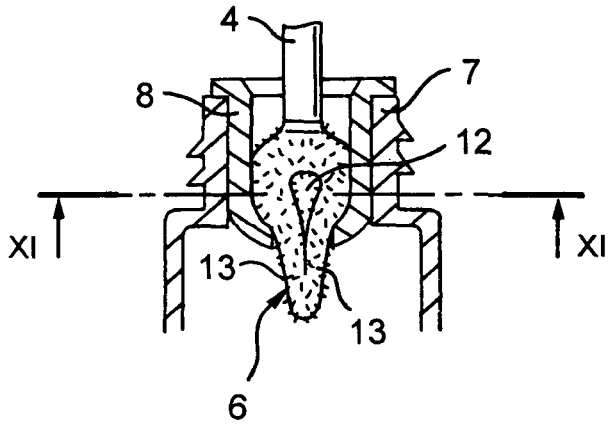
Fig.10
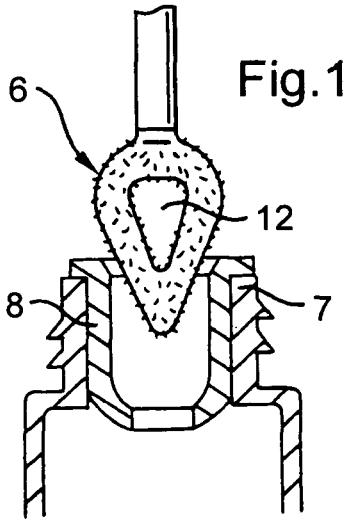
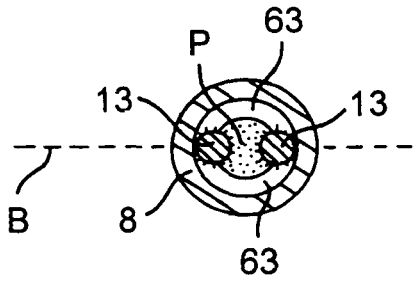
Fig.11

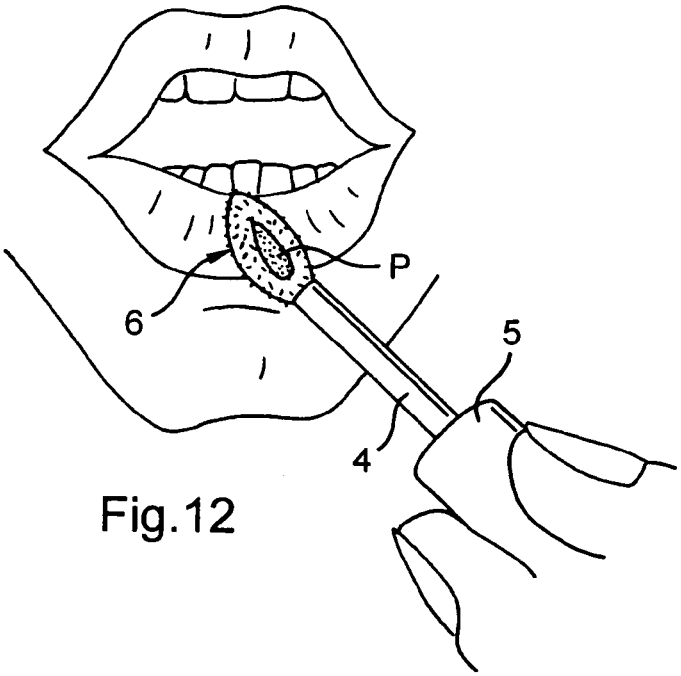
Fig.12
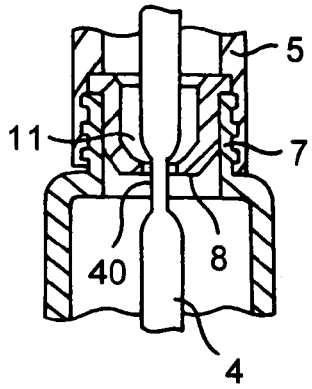
Fig.13
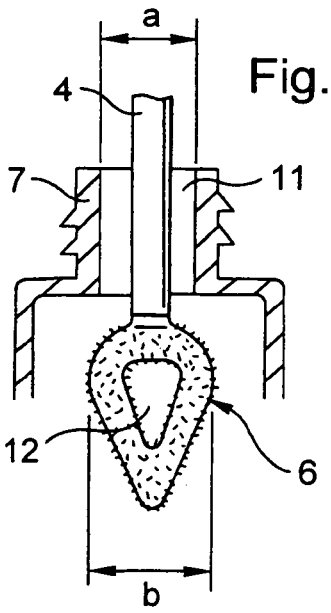
Fig.14
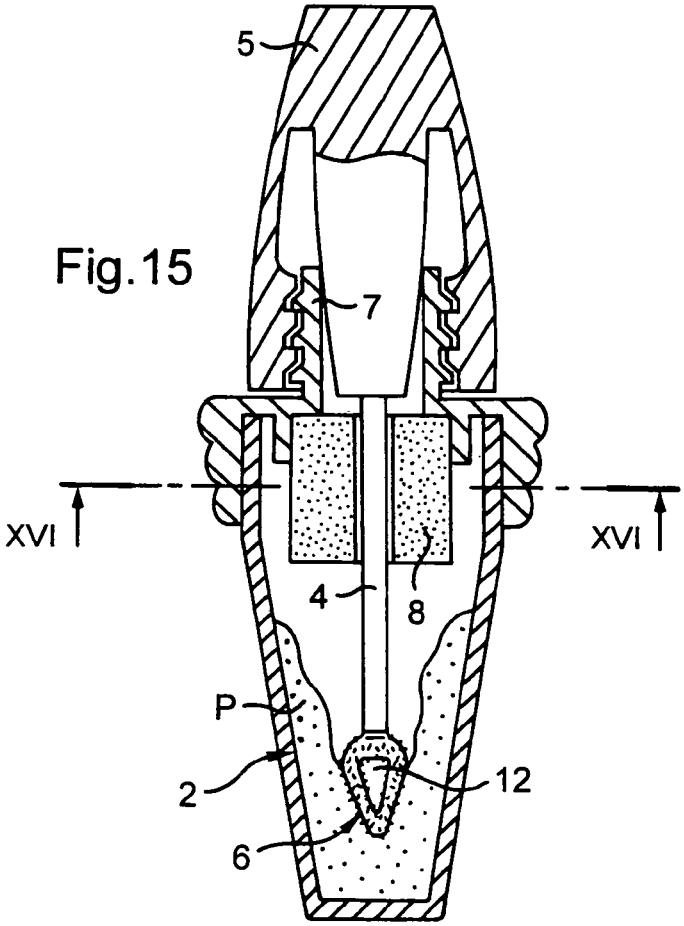
Fig.15
Fig.16
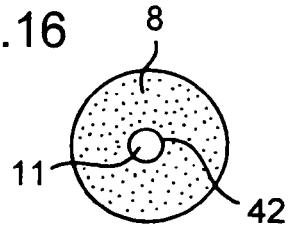

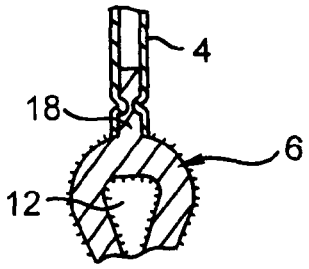
Fig.17
Fig.18
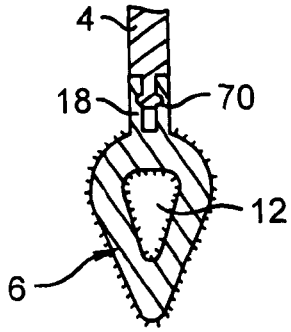
Fig.19
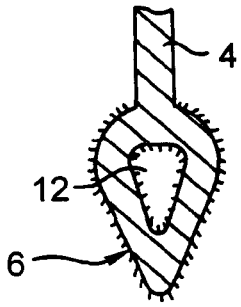
Fig.20
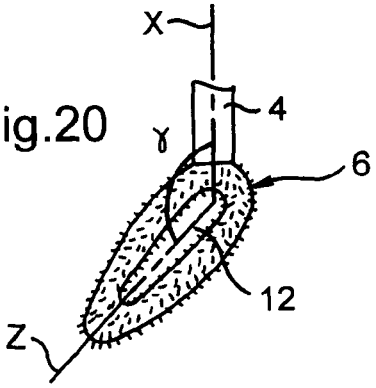
Fig.21
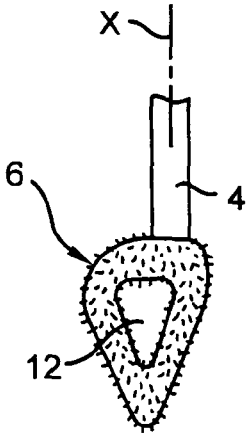
Fig.22
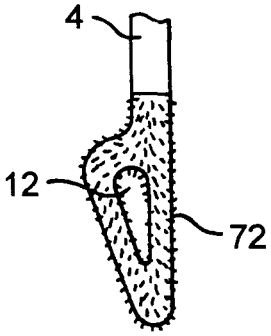
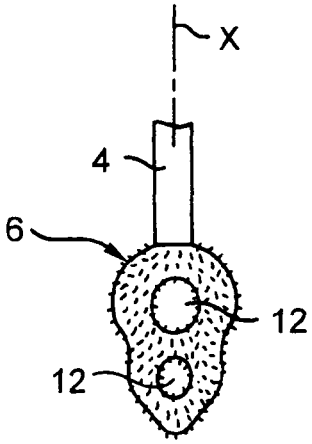
Fig.23
Fig.24
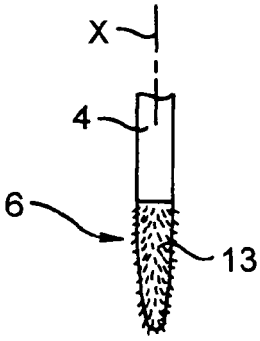
Fig.25
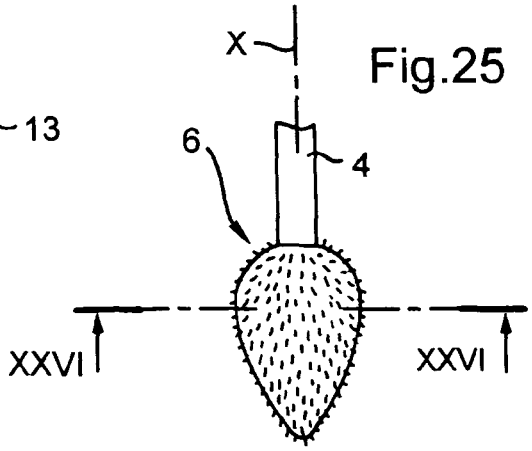

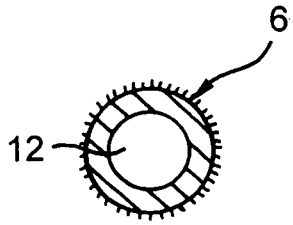
Fig.26
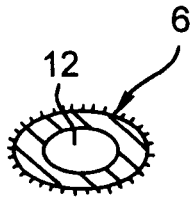
Fig.27
Fig.28
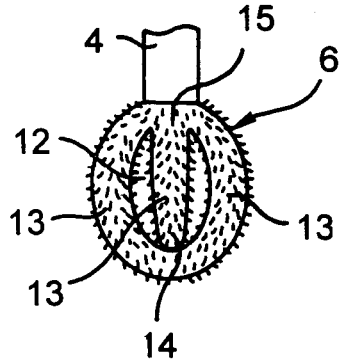
Fig.29
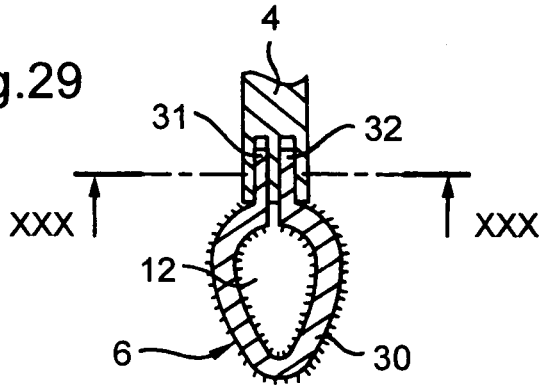
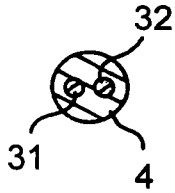
Fig.30
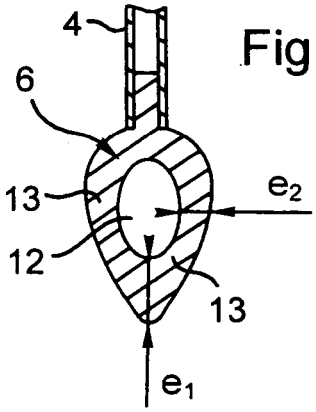
Fig.31
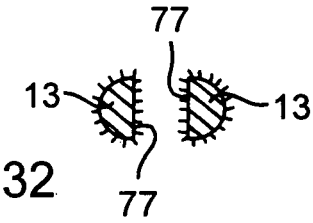
Fig.32
Fig.33
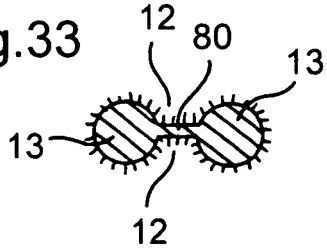
Fig.34
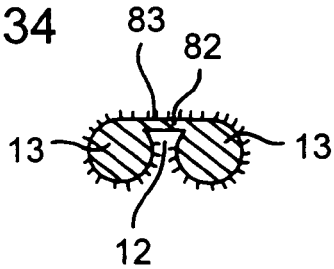

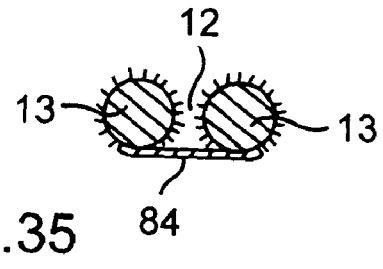
Fig.35
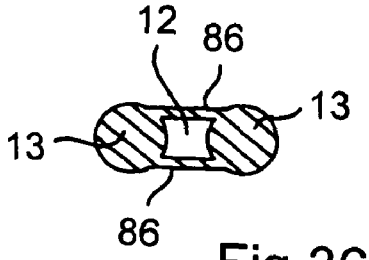
Fig.36
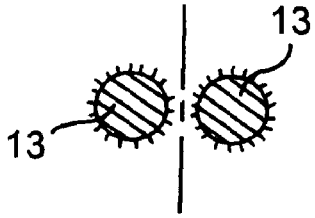
Fig.37
Fig.37A
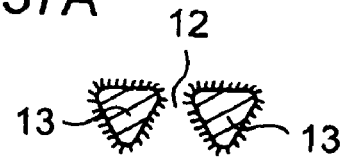
Fig.37B
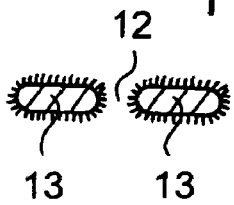
Fig.37C
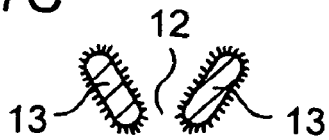
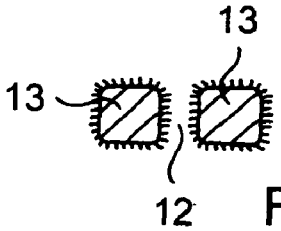
Fig.37D
Fig.37E
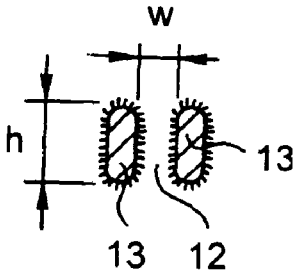

Fig.38
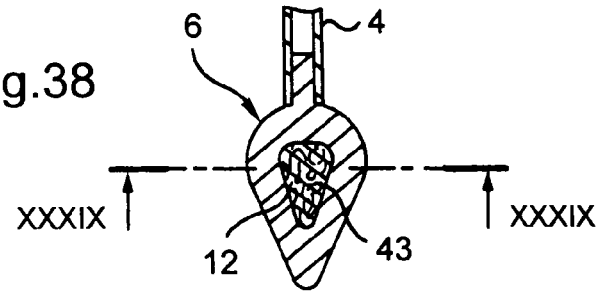
Fig.39
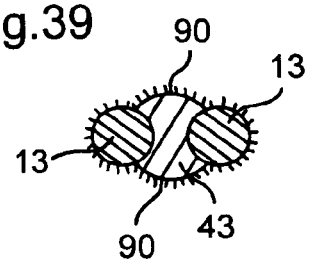
Fig.40
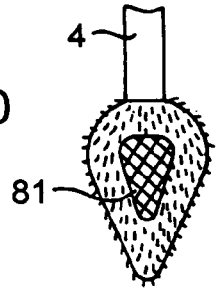
Fig.41
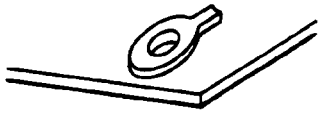
Fig.42
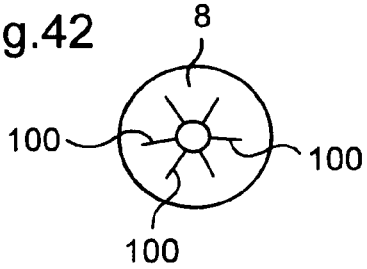
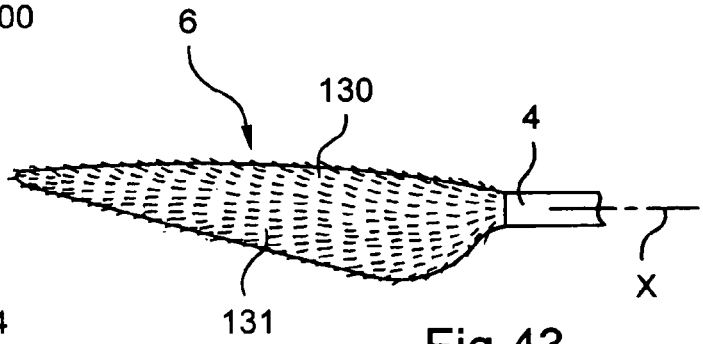
Fig.43
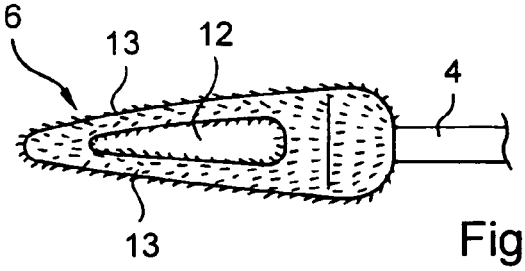
Fig.44

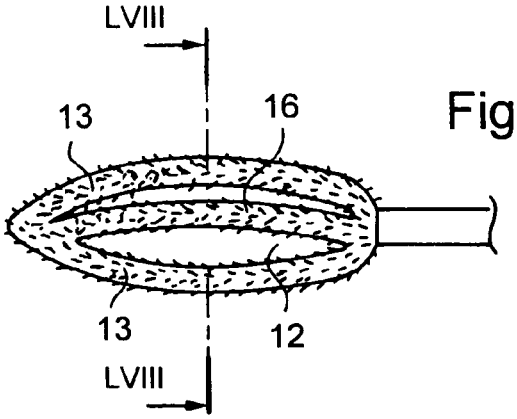
Fig.57
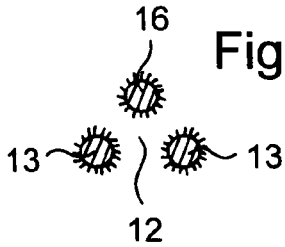
Fig.58
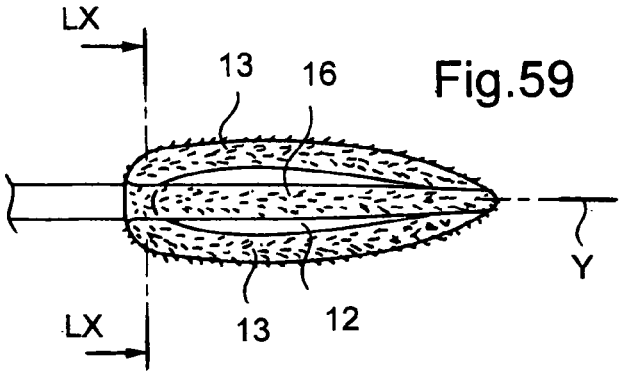
Fig.59
Fig.60
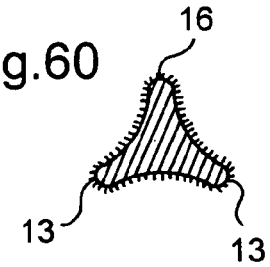
Fig.61
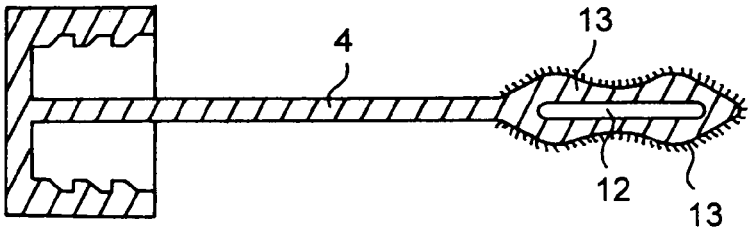
Fig.62
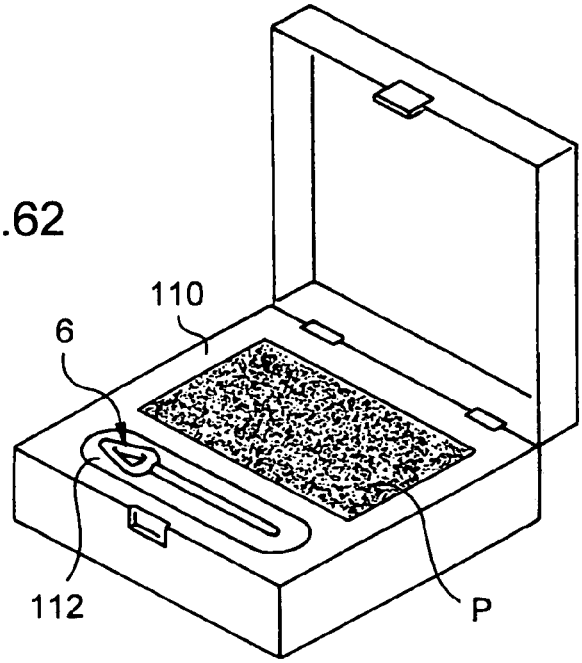

PACKAGING AND APPLICATOR DEVICE FOR APPLYING A COSMETIC OR ANOTHER CARE PRODUCT

This is a Continuation of application Ser. No. 11/178,796 filed Jul. 12, 2005, which is a non-provisional application of U.S. Provisional Application No. 60/601,646 filed on Aug. 16, 2004 and also claims the benefit of French Application No. 04 51528 filed on Jul. 13, 2004. The disclosures of the prior applications are hereby incorporated by reference herein in their entirety.

BACKGROUND

The present invention relates to packaging and applicator devices for applying a cosmetic or other care products.

French patent application FR 2 771 077 describes a packaging and applicator device including an applicator having an applicator element that is suitable for being loaded with substance by being inserted in a receptacle through a wiper member that is constituted, at least in part, by an elastically-deformable porous material.

European patent EP 1 053 695 B1 discloses an applicator including an applicator element that is capable of deforming while passing through the wiper member.

Other applicators are described in, for example, U.S. Patent Application Publication No. 2002/0005209 A1, U.S. Pat. Nos. 6,120,202 and 6,305,861 B1, and European Patents Nos. EP 0 693 263 A1 and EP 0 875 169.

U.S. Pat. Nos. 4,411,282 and 5,826,600 disclose mascara applicators including stacked disks that deform while the applicator is being removed from the receptacle.

U.S. Pat. No. 3,692,417 describes a mascara brush having bristles that bend while passing through the opening of the receptacle.

SUMMARY

The packaging and applicator device described by FR 2 771 077 is relatively complex and costly to make. Additionally, the stem of the applicator is made with a small diameter so as not to deform the wiper member. Thus, the stem is relatively flexible, thereby reducing precision in applying makeup.

The applicator element of the applicator disclosed by EP 1 053 695 B1 includes an application surface that is relatively narrow. Thus, comfort in application is not entirely satisfactory with such an applicator.

Exemplary embodiments of the invention seek to provide an applicator that may be both comfortable and precise, and that may hold sufficient substance to enable application to take place under good conditions.

Exemplary embodiments of the invention provide a packaging and applicator device comprising: an applicator including an applicator element that is elastically deformable at least in part; and a receptacle configured to contain a substance to be applied and configured to house the applicator element when not in use, the receptacle comprising an opening through which the applicator element passes while said applicator element is being removed from the receptacle. The applicator element may comprise at least one inner cavity and may include an outside cross-section that is large enough for the applicator element to deform while passing through the opening, said deformation resulting in a shape of the cavity being modified.

In exemplary embodiments, at least part of the cavity may advantageously be defined by at least two branches of the applicator element that are flocked, at least in part.

In exemplary embodiments, the applicator element may include an application surface that is relatively large, thereby contributing to making the device relatively quick and comfortable to use, for example, for application on skin or on lips.

In exemplary embodiments in which the device is for treating or making up eyelashes or eyebrows, the applicator element may offer new possibilities of applying the substance depending on an orientation given to the applicator element relative to such keratinous fibers.

In exemplary embodiments, the branches may define a greater width for the applicator element.

In exemplary embodiments in which the cavity is made so as to be suitable for being loaded with substance, the cavity may constitute a supply of substance, thereby enabling the applicator element to be used for a greater length of time or enabling a greater quantity of substance to be deposited more easily, for example, to reinforce a makeup effect, such as glossiness of a gloss.

If so desired, exemplary embodiments of the invention make it possible to use a wiper member that deforms little, if at all, while the applicator element is passing therethrough. For example, exemplary embodiments enable use of a wiper member that is made of a material that is not cellular, for example, a polyolefin, such as low-density polyethylene, or an elastomer, so that the wiper member may be relatively inexpensive to manufacture and may be easy to install in the receptacle. Where appropriate or desired, the wiper member may include one or a plurality of slots so as to make it easier for the applicator element to pass therethrough.

In exemplary embodiments, the applicator element may be flocked over at least a fraction of a surface thereof that is used as an application surface. For example, the branches of the applicator element may be entirely flocked.

In exemplary embodiments, the cavity may opens to the outside. In such embodiments, the cavity may open via one or more openings. For example, the cavity may open in at least one face of the applicator element that is used to apply the substance. The cavity may also open in two opposite faces of the applicator element, with at least one of the faces being a face that is used to apply the substance. The cavity may also open via a plurality of passages for the substance, for example, at least three passages that are evenly-spaced angularly about a longitudinal axis of the applicator element.

It may be advantageous for the cavity to open to the outside. Such a configuration may make it easier to deposit the substance contained in the cavity on region to be treated.

In exemplary embodiments, the applicator element may include at least one flexible membrane adjacent to the cavity, the flexibility of said membrane not preventing the applicator element from deforming while passing through the opening of the receptacle. For example, the cavity may be situated between two flexible membranes interconnecting the branches. The membrane may optionally be perforated. For example, the applicator element may include a flexible gauze that extends into at least part of the cavity.

In exemplary embodiments, before the applicator element comes into contact with the substance, the cavity may be empty, i.e., full of air. In other exemplary embodiments, the cavity may be filled, at least in part, with an elastically-deformable material, for example, a material possessing a deformability that is greater than a deformability of a portion of the applicator element defining the cavity. For example, the deformity of the material may be greater than that of the branches and may comprise, for example, low-density foam, felt, or flocking.

In exemplary embodiments, the applicator element may include a plurality of cavities.

In exemplary embodiments, the cavity may include a closed contour in at least one plane. The applicator element may include a thickness of material around the cavity that is not constant in at least one plane. The applicator element may also include a thickness of material around the cavity that is substantially constant in at least one plane.

For example, the cavity may extend over more than half a width of the applicator element. For example, the cavity may extend over more than half a length of the applicator element.

In exemplary embodiments, a variation in a maximum transverse dimension of the applicator element while passing through the opening of the receptacle may be not less than 20%, not less than 40%, or even more.

In exemplary embodiments, the applicator element may include a body made of a thermoplastic material. The body may define the cavity and may be covered, at least in part, by flocking, or may be entirely flocked.

In exemplary embodiments, the applicator element may be made without any metal, thereby enabling the applicator element to be placed in a microwave oven, for example.

In exemplary embodiments, the shape of the applicator element may depend, for example, on a region of the body or the face on which the substance is to be applied.

For lips, for example, the cavity may advantageously extend substantially parallel to a plane forming a non-zero angle with a longitudinal axis of a stem to which the applicator element is connected. At least a portion of the applicator element may thus be elongate along a longitudinal axis which forms a non-zero angle with the longitudinal axis of the stem. The longitudinal axis of the applicator element may also substantially coincide with the longitudinal axis of the stem that carries the applicator element.

In exemplary embodiments, the applicator element may include an envelope surface that may be a surface of revolution. The applicator element may include a shape that is symmetrical relative to a mid-plane, for example, a mid-plane containing the longitudinal axis of the stem. At an end remote from the end of the stem carrying the applicator element, the stem may be connected to a closure cap configured to close the receptacle.

In exemplary embodiments, the applicator element may not have teeth or pegs of elongate shape.

In exemplary embodiments, the receptacle may include a wiper member that may be is fastened in a neck of the receptacle, for example. In other exemplary embodiments, the receptacle may not have a wiper member. The receptacle may have an opening with a smallest cross-section that is circular, regardless of whether or not the receptacle includes a wiper member.

In exemplary embodiments, the applicator element may be fastened onto the stem in various ways. For example, the applicator element may include a fastener endpiece engaged in the stem. The applicator element may include an endpiece that is crimped in the stem, or snap-fastened in or on said stem. Rather than being fastened onto the stem, at least part of the applicator element may also be made integrally as a single piece with the stem.

In exemplary embodiments, the applicator element may comprise a filamentary body with two ends engaged in the stem.

In exemplary embodiments, the stem may include an outside diameter that is not less than 2.5 millimeters (mm), not less than 3 mm, or, for example, about 4 mm, thereby imparting a certain amount of rigidity. Such embodiments may increase precision in applying makeup.

Exemplary embodiments of the invention provide an applicator considered in isolation and independently of a wiper member optionally associated therewith. For example, such an applicator may be associated with a supply of substance that is not necessarily contained in a receptacle including a neck through which the applicator is inserted. For example, the supply of substance may be a mass of substance in the form of a cake, for example, contained in a dish.

Exemplary embodiments of the invention provide a packaging and applicator device for applying a substance onto at least one of skin, mucous membranes, nails, and keratinous fibers, said device comprising: a receptacle configured to contain a substance to be applied, said receptacle including an opening; and an applicator including a stem and an applicator element at one end of the stem, the applicator element being elongate along a longitudinal axis and including a maximum transverse dimension; the applicator element comprising at least two branches configured to move toward each other in a direction of the maximum transverse dimension while the applicator element is passing through the opening of the receptacle.

In exemplary embodiments, the two branches may move toward each other over more than one tenth of the maximum transverse dimension, over more than one eighth or even one fifth of said dimension. The two branches that move toward each other may optionally touch each other while passing through the opening of the receptacle. The two branches may define a cavity between them that may be empty. The two branches may extend along a plane that may form an angle with the longitudinal axis of the stem. The two branches may be without teeth or pegs, for example, being smooth or flocked, for example, in embodiments in which the applicator is for applying a substance onto skin or lips.

In exemplary embodiments, the two branches of the applicator element may include different shapes.

For example, one of the branches may be thicker, thereby enabling the cavity to be off-center. In exemplary embodiments, the cavity may be a single cavity.

In exemplary embodiments, the cavity may include a relatively elongate shape, with a ratio m/n that is not less than 3, 4, 5, or 6, for example, where m designates a length of the cavity and n designates a maximum width of the cavity.

In exemplary embodiments, the width of the cavity may pass through an extremum between two free ends thereof, said external being a maximum, for example.

In exemplary embodiments, the branches may include a longitudinal outside edge that is outwardly convex, outwardly concave, or substantially rectilinear over at least a fraction of a length thereof, for example, about mid-way along the length.

In exemplary embodiments, the outside edge of at least one of the branches may be ridged, at least in part.

In exemplary embodiments, the branches may be flocked, at least in part.

In exemplary embodiments, the applicator element may include flocking hairs with various lengths, with longer hairs in a proximity of a distal end of the applicator element, for example.

In cross-section, the branches may include a shape that is circular, oblong, for example, elliptical, polygonal, with rounded vertices, for example, triangular, square, or rectangular. In exemplary embodiments, the branches may be hollow.

For example, the branches may be made out of an elastomer, for example, a thermoplastic elastomer.

Exemplary embodiments of the invention provide a device for applying a substance onto at least one of skin, mucous membranes, and nails, said device comprising: a receptacle configured to contain a substance to be applied; and an applicator configured to apply the substance, said applicator comprising: a stem; and an applicator element at one end of the stem; the applicator element comprising: two lateral portions; proximal and distal portions interconnecting the lateral portions; a cavity defined between the lateral, distal, and proximal portions; and flocking covering at least part of the lateral, proximal, and distal portions.

In exemplary embodiments, the lateral portions may include longitudinal axes that extend substantially parallel to a common plane that may form an angle with the longitudinal axis of the stem. The longitudinal axes may converge toward the distal portion. The proximal portion may include edges, adjacent to the stem, that slope relative to the longitudinal axis of said stem. Between them, the lateral, proximal, and distal portions may define a cavity that is empty.

In exemplary embodiments, the applicator element may include an endpiece engaged inside the stem. When a section of the stem is circular, the stem may include an outside diameter that is substantially constant, at least for a portion thereof that is inserted in the receptacle in contact with the substance.

In exemplary embodiments, the lateral, proximal, and distal portions may be made by injection molding a thermoplastic material, for example, a thermoplastic elastomer.

In exemplary embodiments, at one end of the stem remote from the applicator element, the applicator may include a closure cap configured to close the receptacle.

In such embodiments, the applicator element may optionally deform between a moment when the applicator element is loaded with substance and a moment when the substance is applied.

BRIEF DESCRIPTION OF THE DRAWINGS

The invention may be better understood on reading the following detailed description of non-limiting embodiments thereof, and on examining the accompanying drawings, in which:

FIG. 6 is a partial cross-sectional view of top portion of the receptacle of FIG. 1 in isolation;

FIGS. 7 to 10 illustrate the applicator element passing through the wiper member;

FIG. 11 is a cross-sectional view of the wiper member and the applicator element taken along XI-XI in FIG. 9;

FIG. 12 illustrates use of the applicator for applying a substance to lips;

FIG. 13 illustrates the possibility of making the stem with a constriction;

FIG. 14 illustrates the possibility of making the receptacle without a wiper member;

FIG. 15 illustrates the possibility of using a wiper member that is made, at least in part, of a cellular material;

FIG. 16 is a cross-sectional view of the wiper member taken along XVI-XVI in FIG. 15;

FIGS. 17 to 19 are views similar to the view of FIG. 5 illustrating other exemplary methods of fastening the applicator element onto the stem;

FIGS. 20 to 23 are views similar to the view in FIG. 2 illustrating other exemplary embodiments of the applicator element;

FIG. 24 is a view similar to the view in FIG. 4 showing another exemplary embodiment;

FIG. 25 is a view similar to the view in FIG. 2 showing another exemplary embodiment;

FIG. 26 is a cross-sectional view taken along XXVI-XXVI in FIG. 25;

FIG. 27 is a view similar to the view in FIG. 26 illustrating another exemplary embodiment;

FIG. 28 is a view similar to the view in FIG. 2 showing another exemplary embodiment;

FIG. 29 is a cross-sectional view similar to the cross-sectional view in FIG. 2 illustrating another exemplary embodiment;

FIG. 30 is a cross-sectional view taken along XXX-XXX in FIG. 29;

FIG. 31 is a cross-sectional view similar to the a cross-sectional view in FIG. 5 illustrating another exemplary embodiment;

FIGS. 32 to 37E are cross-sectional views similar to the cross-sectional views in FIG. 3 illustrating other exemplary embodiments;

FIG. 38 is a cross-sectional view similar to the cross-sectional view in FIG. 5 illustrating another exemplary embodiment;

FIG. 39 is a diagrammatic cross-sectional view taken along XXXIX-XXXIX in FIG. 38;

FIG. 40 is a view similar to the view in FIG. 2 illustrating another exemplary embodiment;

FIG. 41 illustrates the possibility of making the applicator element by cutting-out;

FIG. 42 is a fragmentary face view of another exemplary embodiment of the wiper member;

FIG. 43 is a side view illustrating another exemplary embodiment of an applicator element;

FIG. 44 shows the applicator element of FIG. 43 in plan view;

FIGS. 57 and 59 are diagrammatic perspective views illustrating other exemplary embodiments of applicator elements;

FIGS. 58 and 60 are cross-sectional views taken along LVIII in FIG. 57 and LX in FIG. 59, respectively;

FIG. 61 is a longitudinal cross-sectional view of an exemplary embodiment of an applicator; and FIG. 62 is an exemplary embodiment of an assembly.

DETAILED DESCRIPTION OF EMBODIMENTS

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

Figure 1:
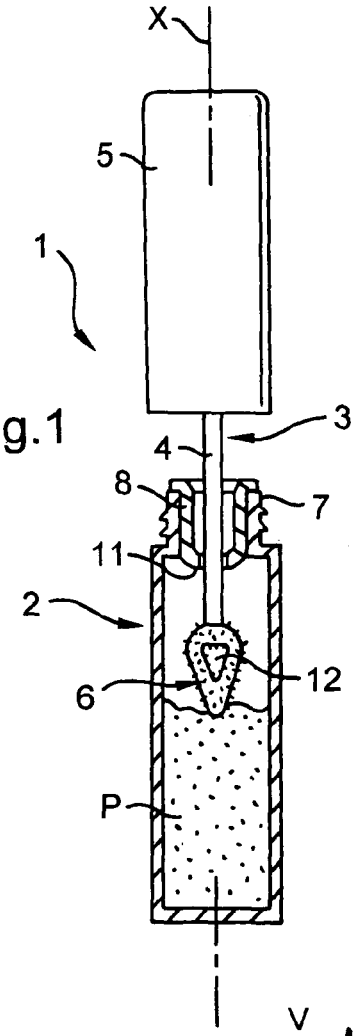
FIG. 1 is a diagrammatic and fragmentary longitudinal cross-sectional view of an exemplary packaging and applicator device.

The exemplary packaging and applicator device 1 shown in FIG. 1 may comprise: a receptacle 2 that may contain a substance P to be applied; and an applicator 3 comprising a stem 4 of longitudinal axis X provided at a first end with a handle 5, which may also constitute a closure cap that seals the receptacle 2 when closed, and provided at an other end thereof with an applicator element 6.

In the exemplary embodiment, an axis X of the stem 4 may be rectilinear, but in other embodiments, the stem 4 may be curved.

A top of the receptacle 2 may be provided with a neck 7 in which a wiper member 8 may be engaged.

The handle 5 may be screwed on the neck 7, but in other embodiments, the handle may be fastened in some other way, for example, by snap-fastening.

As shown in FIG. 6, the wiper member 8 may comprise: a collar 9 that bears against a top edge of the neck 7; and a wiper lip 10, which, in the exemplary embodiment, may define a wiper orifice 11 of circular section and diameter a, for example, of diameter that is substantially equal to a diameter of the stem 4. The stem 4 may include a diameter that is generally greater than 2.5 mm, for example, about 4 mm.

In the exemplary embodiment, the wiper member 8 may be made of a material that is not cellular, for example, a polyolefin or an elastomer. The polyolefin may be polyethylene, for example, such as low- or high-density polyethylene.

In the exemplary embodiment of FIG. 1, an outside surface of the applicator element 6 may be flocked. In other embodiments, the applicator element 6 need not be flocked, or may include, on at least part of the surface, a coating other than flocking, for example, a woven fabric, a non-woven fabric, or a foam, or may include portions in relief, for example, in a criss-cross pattern.

Figure 2:
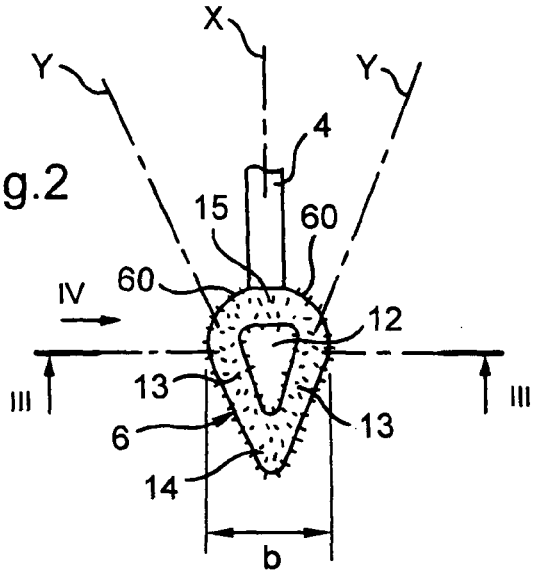
FIG. 2 shows the exemplary applicator element of FIG. 1 in isolation.
Figure 3:
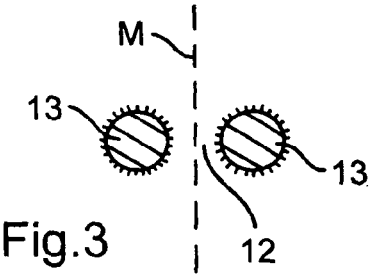
FIG. 3 is a cross-sectional view taken along III-III in FIG. 2.
Figure 4:
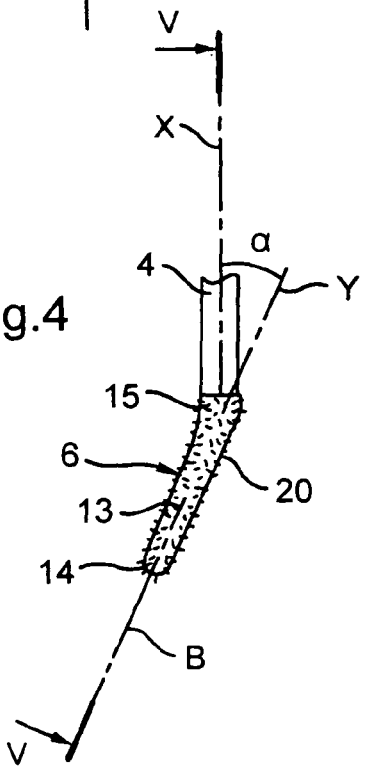
FIG. 4 is a side view as seen looking along arrow IV in FIG. 2.
Figure 5:
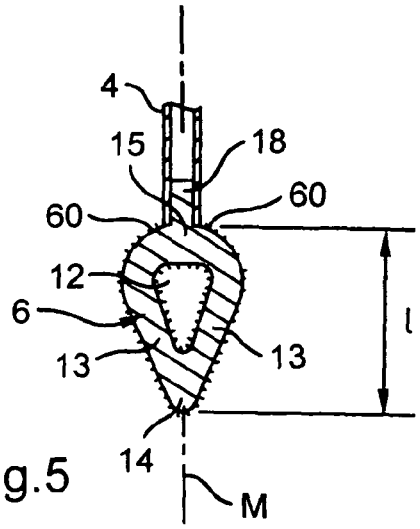
FIG. 5 is a longitudinal cross-sectional view of the applicator element taken along V-V in FIG. 4.

In the exemplary embodiment, and shown in FIG. 5, the applicator element 6 may include a generally-symmetrical shape about a mid-plane of symmetry M, and may include a cavity 12 that is defined laterally by two lateral portions or branches 13, and axially by distal and proximal portions 14 and 15 that interconnect the branches 13. The branches 13 may be elongate along respective longitudinal axes Y that extend substantially parallel to a plane B, as shown in FIG. 4, and that form an angle a with the axis X of the stem 4. The angle $\alpha$ may lie in a range from about 20° to about 30°, for example. An angle $\beta$ between each axis Y and the mid-plane of symmetry M may lie in a range from about 5° to about 45°, for example, as shown in FIG. 2.

Shapes of the distal and proximal portions 14 and 15 may advantageously be selected so as to make it easier to pass through the opening 11 of the receptacle 2. The proximal portion 15 may thus include edges 60 adjacent to the stem 4 that slope relative to the axis X. The distal portion 14 may include a generally tapering shape.

In the exemplary embodiment, the branches 13 may converge toward the distal portion 14 and the cavity 12 may include a substantially triangular shape when the applicator element 6 is observed in elevation.

For example, as shown in FIG. 5, the cavity 12 may extend over more than one fourth of a width b of the applicator element 6 and over more than one fourth of a length l of the applicator element 6. The dimensions of the cavity 12 may be selected as a function of deformability required to pass through the opening 11 of the receptacle and/or as a function of a quantity of substance that might be desired to retain in the cavity 12, for example, by capillarity, after the applicator has been removed from the receptacle.

The width b of the applicator element 6 may be greater than a smallest diameter a of the wiper member 8, so that the applicator element 6 may deform while passing through said wiper member 8, as illustrated in FIGS. 7 to 10.

For example, the lateral portions 13 may move toward each other, substantially parallel to the direction D of the maximum transverse dimension, to a point that facing faces thereof may touch each other, the shape of the cavity 12 being modified while the applicator element 6 is passing through the wiper member 8.

For example, a ratio b/a may be greater than 1 to 2, 1 to 4, or 1 to 6, so that a variation to which the maximum transverse dimension of the applicator element is subjected while passing through the opening 11 may be substantial. For example, the width b may be about 9 mm and the dimension a may be about 4 mm.

A widest portion of the applicator element 6 may preferably be a most flexible portion.

After passing through the opening 11 of the receptacle, the applicator element 6 may return to an initial shape thereof, for example, via its own elasticity, as shown in FIG. 10.

As shown in FIG. 11, the substance P may be forced out of the cavity 12 while passing through the wiper member 8, while the lateral portions 13 are moving toward each other. In the exemplary embodiment, spaces 63 nevertheless may exist on either side of the applicator element 6 when the branches 13 are moved toward each other, and the substance P may extend into these spaces 63. When the branches 13 again move apart, the substance P may return into the cavity 12. The spaces 63 may prevent the applicator element 6 from being wiped excessively while passing through the wiper member 8.

The substance P in the cavity 12 may increase a length of time the applicator may be used, and may also improve comfort in application by making it easier for the applicator to slide over a surface being treated.

For example, the substance P may be configured to apply onto lips. The user may deposit the substance on said lips by bringing a rear face 20 of the applicator element 6 into contact therewith, as shown in FIG. 12, for example. In the exemplary embodiment, the rear face 20 may corresponds to a face that is situated on a rear side when the applicator element 6 is observed with the lateral portions 13 extending forward.

During application, depending on which surface of the applicator element 6 is in contact with the zone being treated, a thickness of the substance that is deposited may differ, thereby enabling the user to vary glossiness when the substance comprises makeup, for example.

When the applicator element 6 is applied flat, the substance P in the cavity 12 may be deposited. The surface loaded with substance P coming into contact with, for example, the lips may be relatively large, so that the lips may be made up quite quickly.

Where appropriate or desired, application may be performed using only the end of the distal portion 14, for example, for drawing an outline.

When the stem 4 and the applicator element 6 need to be wiped more vigorously, the wiper member 8 may be made with a smaller diameter. If necessary, it is thus possible to make the stem 4 with a constriction 40, as shown in FIG. 13, said constriction 40 preventing the wiper member 8 from being mechanically stressed when the receptacle is closed.

The device 1 may also be made without a separate wiper member insert in the neck 7 of the receptacle, for example, as shown in FIG. 14. As shown in FIG. 14, the neck 7 may include the smaller inside diameter a that is smaller than the width b of the applicator element 6, so that the applicator element 6 deforms while passing through the opening 11 of the receptacle.

In an exemplary embodiment not shown, the receptacle 2 may be made with an overmolded wiper member.

FIG. 15 illustrates the possibility of using a wiper member 8 other than the wiper member 8 shown in FIG. 1.

In FIG. 15, the wiper member 8 may be constituted by a block of cellular material that is elastically compressible.

The wiper member 8 may include a through hole 42 passing through a center thereof and defining the opening 11 of the receptacle, as shown in FIG. 16.

For example, a diameter of the through hole 42 may correspond substantially to the diameter of the stem 4.

Whatever its nature, whether cellular or not, the wiper member 8 may include one or more slots that may include touching edges.

The applicator may be used in association with a slotted wiper. For example, FIG. 42 illustrates an exemplary a wiper member 8 including a central opening, through which the stem and the applicator element 6 may pass, and a plurality of slots 100, which may be radial.

The applicator element 6 may be fastened onto the stem 4 using various means.

In the exemplary embodiment of FIG. 1, the proximal portion 15 may be extended, as shown in FIG. 5, by an endpiece 18 engaged inside the stem 4.

The endpiece 18 may be bonded, stapled, or heat-sealed in the stem 4. The stem 4 may also be crimped onto the endpiece 18, as shown in FIG. 17.

FIG. 18 illustrates the possibility of securing the applicator element 6 to the stem 4 by snap-fastening For example, the endpiece 18 may be configured so as to be snap-fastened on a head 70 formed at the end of the stem 4.

In an exemplary embodiment not shown, the stem 4 may be is snap-fastened on the endpiece 18.

The body of the applicator element 6 may also be made integrally as a single piece with the stem 4, as shown in FIG. 19.

FIG. 20 illustrates the possibility of at least a fraction of the applicator element 6 extending along a longitudinal axis Z that forms an angle y with the longitudinal axis X of the stem 4, the axes X and Z being situated in a common plane, and the cavity 12 extending substantially parallel to said plane.

FIG. 21 illustrates the possibility of the applicator element 6 including a shape that is not symmetrical about the axis X of the stem 4. Where appropriate or desired, and as shown in FIG. 22, the applicator element 6 may include an edge 72 extending substantially in alignment with the stem 4.

The applicator element 6 may also include more than one cavity 12, for example, two cavities 12, as shown in FIG. 23.

For example, each both cavities 12 may be aligned along the longitudinal axis of the applicator element 6. The applicator element 6 may be generally 8-shaped when viewed from the front.

In the exemplary embodiment of FIG. 1, the applicator element 6 may extend obliquely relative to the longitudinal axis X of the stem 4.

In an exemplary embodiment not shown, the applicator element 6 may also be elongate along a longitudinal axis that is curvilinear.

The applicator element 6 may be made in some other way, for example. Each branch 13 may, for example, extend with the longitudinal axis Y thereof situated in a plane that is parallel to the longitudinal axis X of the stem 4, as shown in FIG. 24.

In the exemplary embodiment of FIG. 1, for example, the cavity 12 may open at a front and at a rear of the applicator element 6, when said applicator element is observed face-on, as in FIG. 2.

It is not beyond the ambit of the present invention for the cavity 12 to open to the outside in some other way, or even to be completely enclosed in the applicator element 6, as shown in FIGS. 25 and 26. In such embodiments, the applicator element 6 may include an envelope surface that is substantially a surface of revolution about a longitudinal axis thereof. The envelope surface may also have some other shape, for example, in embodiments in which the applicator element 6 includes an oval cross-section, as shown in FIG. 27.

In the exemplary embodiment of FIG. 28, the applicator element 6 may include more than two intermediate portions 13 joining the proximal and distal portions 15 and 14 together. The intermediate portions 13 may be three or four in number and may be disposed about the cavity 12 which opens to the outside via openings formed between the intermediate portions 13. The intermediate portions 13 may include an arcuate shape that is inwardly concave.

FIGS. 29 and 30 illustrate an exemplary applicator element 6 that may be formed by a solid or hollow filamentary body 30 including two ends 31 and 32 engaged in corresponding housings of the stem 4.

FIG. 31 illustrates the possibility of making the applicator element 6 with a thickness of material that is not constant around the cavity 12 in at least one plane. As shown in FIG. 13, the thickness of material may vary from a maximum thickness e1 to a minimum thickness e2, for example, at the branches 13.

Over at least a fraction of a length thereof, the branches 13 may include a solid cross-section of circular shape, for example.

FIG. 32 illustrates the possibility of the branches 13 including some other shape in cross-section, for example, with substantially plane facing faces 77.

In an exemplary embodiment not shown, the branches 13 may be hollow.

In the exemplary embodiments described above, the cavity 12 may be full of air before the applicator element 6 comes into contact with the substance contained in the receptacle. This does not have to be the case.

Thus, for example, at least part of the cavity 12 may be occupied by flocking extending over the body of the applicator element 6, as shown in the exemplary embodiment of FIG. 37. For example, hairs of the flocking covering the body of the applicator element 6 may be long enough for the hairs situated on the facing faces of the branches 13 to meet.

FIGS. 37A to 37E illustrate the possibility of the branches 13 including various shapes in cross-section, for example, substantially polygonal, such as triangular, as shown in FIG. 37A, or square, as shown in FIG. 37D, flat and substantially parallel to a plane of the cavity 12, as shown in FIG. 37B, or even flat and oriented obliquely so that the cavity 12 opens outward via two unequal openings, as shown in FIG. 37C.

Whatever the cross-section, the branches 13 may, for example, include a height h that is greater than a width w of the cavity 12 between the branches 13, as shown in FIG. 37E.

As shown in FIG. 33, the applicator element 6 may include two cavities 12 that are separated by a flexible membrane 80 joining the branches 13 together and situated at a mid-thickness of said branches 13, for example.

The membrane 80 may be flocked. Flexibility of the membrane 80 may not prevent the applicator element 6 from deforming sufficiently to pass through the opening of the receptacle, if necessary. The membrane 80 may be replaced by a gauze 81, as shown in FIG. 40. The cavity 12 may open on only one face of the applicator element 6, as shown in FIG. 34, the applicator element being able to include a membrane 82 defining at least part of the application surface by an outside face 83 thereof. In an exemplary embodiment not shown, at least one orifice may enable the substance contained in the cavity 12 to reach the outside face 83 through the membrane 82.

The membranes 80 or 82 may be molded integrally as a single piece with the branches 13.

The membrane 82 may be replaced by a fitted membrane 84, as shown in FIG. 35. The membrane 84 may comprise, amongst other things, woven or non-woven material, foam, perforated film, gauze, or felt, and may be fastened by heat sealing or adhesive, for example.

The membrane 84 may be permeable to the substance P contained in the cavity 12.

In the exemplary embodiment of FIG. 36, the cavity 12 may be formed between two flexible membranes 86 which may join the branches 13 together.

The membranes 86 may be fastened onto a remainder of the applicator element 6, or may be made integrally as a single piece with the body of said applicator element 6. The membranes 86 may be permeable to the substance P.

In the exemplary embodiments of FIGS. 33 to 36, the membranes 80, 82, 84, or 86 may be elastically deformable.

When necessary or desired, as shown in FIGS. 38 and 39, the cavity 12 may be filled, at least in part, with a material 43 that does not unduly prevent the applicator element 6 from deforming while passing through the opening of the receptacle. For example, the material 43 may be a low-density foam that includes very open cells and that may be deformed more easily than the body of the applicator element 6 surrounding the cavity 12. Where appropriate or desired, an outside of the material 43 may be flocked, for example, as shown in FIG. 39. At least one outside face 90 thereof may define at least part of the application surface.

For example, the body of the applicator element 6 may be made, at least in part, by injection molding a thermoplastic material, for example, polyvinyl chloride (PVC), polyurethane (PU), ethylene vinyl acetate copolymer (EVA), styrene-isoprene-styrene/styrene-ethylene-butylene (SIS-SEB), nitrile, silicone, ethylene-propylene terpolymer rubber (EPDM), Hytrel®, Pebax®, Santoprene®, other thermoplastics or elastomers.

The applicator element 6 may be made of materials that are not thermoplastic, for example, flexible resins, or may be made in a way other than by molding, for example, by cutting-out, as illustrated in FIG. 41.

FIGS. 43 and 44 illustrate an exemplary applicator element 6 that includes top and bottom faces 130 and 131 that converge toward the distal end of the applicator element 6, at least along a fraction of the cavity 12.

For example, the longitudinal axis X of the stem 4 may be substantially parallel to one of said faces, for example, the top face 130.

In this exemplary embodiment, the applicator element 6, when observed from above, as shown in FIG. 44, may include substantially rectilinear longitudinal edges that converge toward the distal end.

The applicator elements shown in FIGS. 45 to 61 may advantageously be used for applying makeup or other care products onto keratinous fibers, for example, eyelashes or eyebrows.

In such applicator elements, the cavity 12 may include an elongate shape, with a ratio of the length m of the cavity to the maximum width n of said cavity not being less than 3, 4, 5, or 6, for example. In other words, $3 \leqq m/n \leqq 6$, for example.

Figure 45:
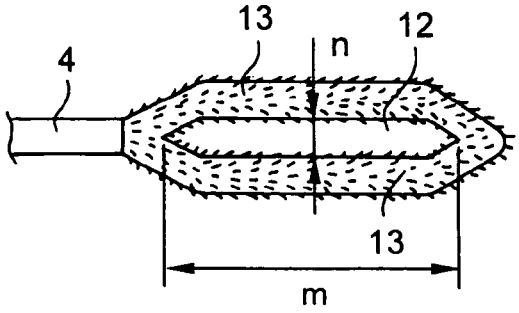
FIGS. 45 to 56 are plan views illustrating other exemplary embodiments of applicator elements.

FIG. 45 illustrates an exemplary applicator element 6 including a cavity 12 with a width that is substantially constant over at least half of a length thereof. The longitudinal edges of the branches 13 may be rectilinear and parallel to each other on either side of a mid-portion situated mid-way along the cavity.

Figure 46:
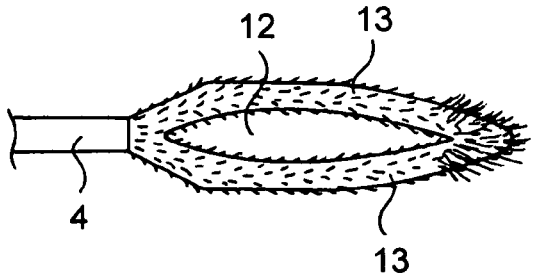

In the exemplary embodiment of FIG. 46, the applicator element 6 may be flocked. A distal portion of the applicator element 6 may be covered in hairs that are longer than the hairs covering the branches 13. The distal portion may serve to apply makeup to a corner of an eye, for example.

Figure 47:
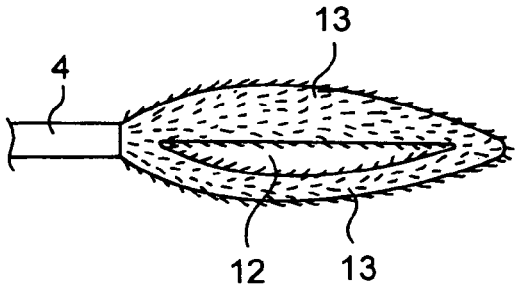

In the exemplary embodiment of FIG. 47, the branches 13 may include widths that are unequal. Thus, the cavity 12 may be off-center.

Figure 48:
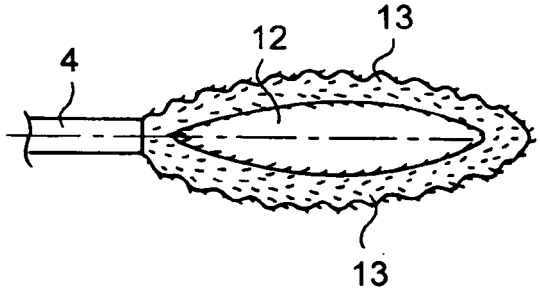

In the exemplary embodiment of FIG. 48, the longitudinal edges of the branches 13 may appear ridged when the applicator element 6 is observed from above.

Figure 49:
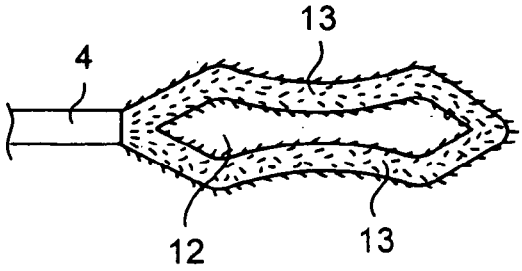

FIG. 49 illustrates the possibility of the branches 13 of the applicator element 6 including longitudinal edges that are outwardly concave. The cavity 12 may thus include a width passing via a minimum between two axial ends thereof.

Figure 50:
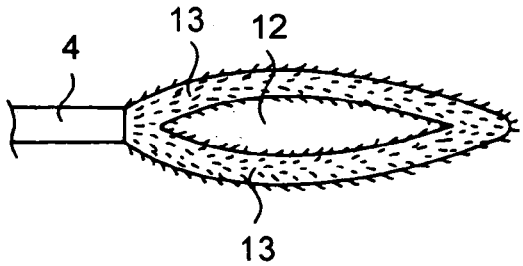

In the exemplary embodiment of FIG. 50, the longitudinal edges of the branches may be outwardly convex and the cavity 12 may include a shape that is lenticular when observed from above.

Figure 51:
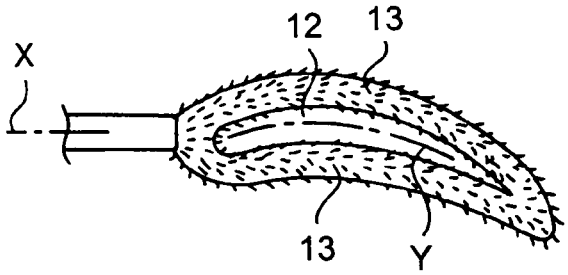

The exemplary applicator element 6 shown in FIG. 51 may include a longitudinal axis Y that is curvilinear and a free end of the applicator element 6 may not be situated on the longitudinal axis X of the stem 4. One of the branches 13 may include an outside edge that is outwardly convex and the other branch 13 may include an outside edge that is outwardly concave.

Figure 52:
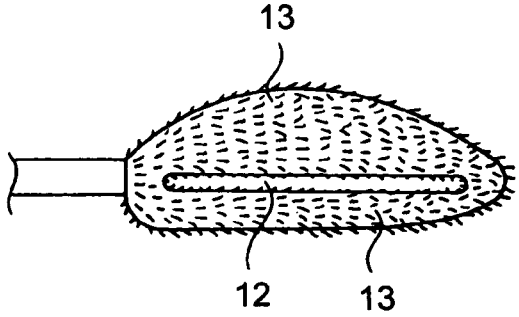

The exemplary applicator element of FIG. 52 may include a branch 13 including an outside edge that is outwardly convex and another branch 13 including an outside edge that is rectilinear. In addition, as shown in FIG. 52, the cavity 12 may be relatively narrow and may form a capillary slot, for example.

Figure 53:
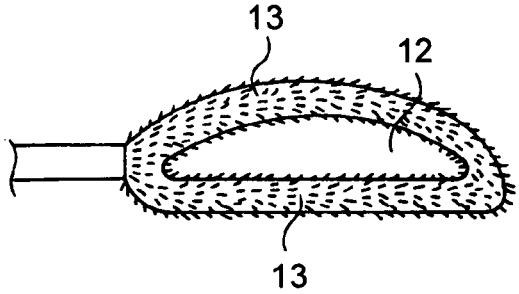

In the exemplary embodiment of FIG. 53, the cavity 12 may be wider than in the exemplary embodiment of FIG. 52 and may include a width that varies passing through an extremum.

Figure 54:
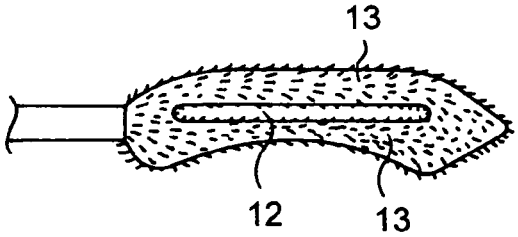

FIG. 54 illustrates the possibility of the applicator element 6 including two branches 13, one of which includes an outside edge that is rectilinear and the other of which includes an outside edge that is outwardly concave.

Figure 55:
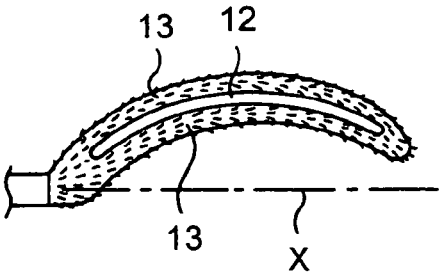

In the exemplary embodiment of FIG. 55, the exemplary applicator element 6 may include a longitudinal axis that is curvilinear, as in the exemplary embodiment of FIG. 51, and a free end of the applicator element 6 may be situated on a same side of the longitudinal axis X of the stem 4 as practically all of a remainder of the applicator element 6.

Figure 56:
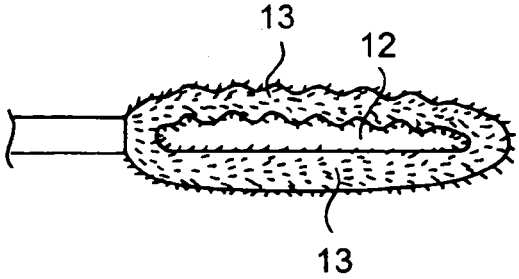

FIG. 56 illustrates the possibility of one of the branches 13 of the applicator element 6 including grooves, whereas the other branch 13 may not include any grooves. For example, the grooves may extend transversely to the branch 13.

FIGS. 57 and 59 illustrate exemplary applicator elements that may include a third branch 16 that joins the distal and proximal portions of the applicator element 6 together.

In the exemplary embodiment of FIG. 57, the third branch 16 may be situated on one side of a plane defined by the longitudinal axes of the two branches 13, as shown in FIG. 58. The third branch 16 may include an arcuate shape, for example.

In the exemplary embodiment of FIG. 59, the two first branches 13 and the third branch 16 may be disposed evenly about the longitudinal axis Y of the applicator element 6, a proximal portion of the applicator element 6 including a cross-section that is generally in a shape of a triangle or a three-pointed star, as shown in FIG. 60, for example.

FIG. 61 illustrates the possibility of making the body of the applicator element 6 integrally as a single piece with the stem 4 and with the handle 5, which may also serve as a closure member for closing the receptacle.

The applicator elements in FIGS. 45 to 61 may be made, at least in part, by molding material, for example, a thermoplastic material.

The applicator elements in FIGS. 45 to 61 may allow eyelashes to be loaded with a relatively large quantity of substance. Two branches 13 of the applicator element 6 may be used simultaneously or successively to apply substance onto eyelashes.

For all of the exemplary applicator elements described above, applying substance may, where appropriate or desired, be performed in various ways depending on a desired result. The applicator element 6 may be used flat, on edge, or at various angles of inclination, for example, with a selected orientation enabling the user to control an intensity of makeup, for example.

When the applicator element 6 is observed face-on, the applicator element 6 may include shapes other than the shapes shown, including, for example, lozenge shaped, circular, or elliptical.

The exemplary applicator elements 6 may include magnetic particles.

In exemplary embodiments in which the applicator element is deformable, advantage may be taken of such deformability to recover substance that adheres to an inside surface of the receptacle.

An applicator element 6 including a clearly elongate shape, such as the exemplary applicator elements of FIGS. 45 to 61, for example, may advantageously be made so as to make such deformation possible.

Naturally, the invention is not limited to the exemplary embodiments described above. In particular, it is possible to combine the characteristics of the various exemplary embodiments.

In exemplary embodiments of the invention, all of the exemplary applicator elements described above, and, for example, the exemplary applicator elements described with reference to the drawings, may also be used without the applicator element being deformed between being loading with substance and said substance being applied, for example, when the applicator elements are used in association with a supply of substance contained other than in a receptacle provided with a neck.

In such embodiments, the stem 4 of the applicator need not include the handle 5.

For example, the substance P, in the form of a paste, a compacted powder, or a loose powder, or the like, may be contained in a dish of a compact 110, as shown in FIG. 62.

The applicator may be received in a corresponding housing 112 of the compact 110.

The applicator element may be loaded with substance by being brought into contact with said substance. The applicator element may optionally deform when the substance is taken.

The terms "comprising a" and "including a" should be understood as being synonymous with the terms "comprising at least one" and "including at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device comprising:

an applicator including an applicator element, the applicator element being at least partially elastically deformable and having a body made of a thermoplastic material; and a receptacle configured to contain a substance to be applied and configured to house the applicator element when not in use, the receptacle comprising an opening through which the applicator element passes while the applicator element is being removed from the receptacle, wherein the applicator element comprises at least two branches defining a periphery of and surrounding an inner cavity, the two branches being at least partially flocked, and wherein an outside cross-section of the applicator element is large enough for the applicator element to deform while passing through the opening of the receptacle, the deformation resulting in a shape of the cavity being modified, wherein the cavity comprises an elongate shape with a ratio m/n that is not less than 3, where m designates a length of the cavity and n designates a maximum width of the cavity.

2. The device according to claim 1, wherein the ratio m/n is not less than 6.

3. The device according to claim 1, wherein the cavity has a width n that is substantially constant over at least half the length m.

4. The device according to claim 1, wherein edges associated with the two branches are rectilinear and parallel to one another at a mid-portion midway along the cavity.

5. The device according to claim 1, wherein the receptacle comprises a wiper member.

6. The device according to claim 5, wherein the wiper member is fastened in a neck of the receptacle.

7. The device according to claim 1, wherein the two branches are ridged.

8. The device according to claim 1, wherein a first of the two branches is rectilinear and the second of the two branches is outwardly convex.

9. The device according to claim 1, wherein the width n varies along the length m.

10. The device according to claim 1, wherein the applicator element has an axis that is curvilinear.

11. The device according to claim 1, wherein at least one branch of the at least two branches includes a groove extending transversely to the at least one branch.

12. The device according to claim 1, further comprising a third branch.

13. The device according to claim 12, wherein the at least two branches and the third branch are disposed evenly around a longitudinal axis of the applicator element.

14. The device according to claim 1, wherein the at least two branches comprise a thermoplastic material.

15. The device according to claim 14, wherein the at least two branches are formed integrally with a stem and a handle associated with the applicator.

16. A device comprising:

an applicator including an applicator element that is at least partially elastically deformable; and a receptacle configured to contain a substance to be applied and configured to house the applicator element when not in use, the receptacle comprising an opening through which the applicator element passes while the applicator element is being removed from the receptacle, wherein the applicator element comprises at least one inner cavity that is defined, at least in part, between at least two branches that are at least partially flocked, and wherein an outside cross-section of the applicator element is large enough for the applicator element to deform while passing through the opening of the receptacle, the deformation resulting in a shape of the cavity being modified;

wherein the cavity comprises an elongate shape with a ratio m/n that is not less than 3, where m designates a length of the cavity and n designates a maximum width of the cavity, and wherein the at least two branches are void of teeth or pegs of elongate shape molded with the at least two branches.

17. The device according to claim 16, wherein the receptacle includes a wiper member that is fastened in a neck of the receptacle, and the wiper member is made of a non-cellular material.

18. The device according to claim 17, wherein the wiper member is made of at least one of a polyolefin and an elastomer.

19. A device comprising:

an applicator including an applicator element, the applicator element being at least partially elastically deformable;

a receptacle configured to contain a substance to be applied and configured to house the applicator element when not in use, the receptacle comprising an opening through which the applicator element passes while the applicator element is being removed from the receptacle, wherein the applicator element comprises at least one inner cavity that is defined, at least in part, between at least two branches that are at least partially flocked, and wherein a portion of the at least two branches are deformed in a direction perpendicular to a longitudinal axis of the applicator element while passing through the opening of the receptacle, the deformation resulting in a temporary reduction in volume associated with the cavity.

20. The device of claim 19, wherein prior to and after deformation, the cavity comprises an elongate shape with a ratio m/n that is not less than 3, where m designates a length of the cavity and n designates a maximum width of the cavity.

* * * * *